US006350141B1

(12) United States Patent
Houtz

(10) Patent No.: US 6,350,141 B1
(45) **Date of Patent: *Feb. 26, 2002**

(54) CONNECTOR FRAME FOR A HIGH DENSITY ELECTRICAL CONNECTOR

(75) Inventor: Timothy W. Houtz, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/583,034

(22) Filed: May 30, 2000

(51) Int. Cl.[7] ..... H01R 13/625

(52) U.S. Cl. ..... 439/341; 439/74; 439/376; 439/924.1

(58) Field of Search ..... 439/341, 51, 376, 439/74, 75, 924.1, 268, 261

(56) References Cited

U.S. PATENT DOCUMENTS

| | | | | |
|---|---|---|---|---|
| 3,133,775 A | | 5/1964 | Plaxa | |
| 4,257,665 A | | 3/1981 | John et al. | |
| 4,503,608 A | | 3/1985 | Evans | 29/839 |
| 4,761,140 A | | 8/1988 | Geib | 439/71 |
| 4,869,681 A | | 9/1989 | Vache et al. | 439/341 |
| 4,941,840 A | | 7/1990 | Okada | 439/376 |
| 5,000,689 A | * | 3/1991 | Ishizuka et al. | 439/341 |
| 5,215,472 A | | 6/1993 | DelPrete et al. | 439/71 |
| 5,268,820 A | * | 12/1993 | Tseng et al. | 439/44 |
| 5,302,136 A | | 4/1994 | St. Germain et al. | 439/376 |
| 5,378,169 A | | 1/1995 | Volz et al. | 439/376 |
| 5,602,719 A | * | 2/1997 | Kinion | 439/376 |
| 5,876,219 A | * | 3/1999 | Taylor et al. | 439/74 |
| 6,093,042 A | * | 7/2000 | Lemke et al. | 439/341 |
| 6,155,860 A | * | 12/2000 | Lemke et al. | 439/341 |

* cited by examiner

*Primary Examiner*—Tho D. Ta
(74) *Attorney, Agent, or Firm*—Woodcock Washburn LLP

(57) ABSTRACT

A connector frame including a first component and a second component. The frame components substantially surround first and second connector halves, each half including an insulative housing and a plurality of contacts secured to the insulative housing. The frame components engage in order to progressively mate the contacts of the connector. A method of mating a connector including the steps of engaging the first and second components of the connector frame; and progressively connecting the contacts of the first and second connector halves.

37 Claims, 16 Drawing Sheets

CONNECTOR FRAME FOR A HIGH DENSITY ELECTRICAL CONNECTOR

RELATED APPLICATION

This invention is related to commonly assigned U.S. patent application Ser. No. 09/209,132, filed on Dec. 10, 1998, U.S. Pat. No. 6,093,042, herein incorporated by reference.

BACKGROUND OF THE INVENTION

1. Field of the Invention

The present invention relates to an electrical connector and more particularly to a connector frame for use with such a connector for achieving a low insertion force in an electrical connector with a high density and/or a large number of contacts.

2. Brief Description of Earlier Developments

Contemporary improvements in computer systems and communications equipment generally involve miniaturization and increased operating speeds. Designers must adapt the electrical connectors used in these systems to cope with such changes. Various attempts to reduce the size of electronic equipment, e.g. personal portable devices and integrated circuits, and to add additional functions to such equipment has resulted in an ongoing drive for miniaturization of all components, especially the electrical connectors. Efforts to miniaturize electrical connectors have included reductions in the pitch between terminals in single or double row linear connectors, so that a relatively high number of I/O or other lines can be interconnected.

Several types of electrical connectors exist that have adapted to miniaturization and to the increased operating speeds. One type is a zero insertion force (ZIF) connector. ZIF connectors use a force reduction mechanism either to spread a contact apart before receiving its mating contact or to provide mechanical advantage to a contact so that it may spread apart and engage its mating contact.

While beneficial in larger applications, current ZIF designs may not be preferred in high contact density, miniaturized environments. Due to the addition of a force reduction mechanism, ZIF connectors can be complex and costly, particularly when miniaturization is required. In addition, the use of smaller actuators may not have sufficient strength to spread a contact apart or to mate the contacts. The actuators also may not fit within footprint limitations. ZIF connectors may not provide sufficient contact wipe to ensure a stable electrical contact. Furthermore, even with a mechanical advantage, ZIF connectors may still have a peak insertion force that is undesirably high when each contact mates simultaneously.

Another type of electrical connector proposed for use in the high density, miniaturized environment, incorporates plug and receptacle halves, wherein one of the halves includes contacts with differential heights. Some of the contacts reside at one elevation, while the others reside at a different elevation. As the connector halves are pressed together, the taller contacts mate first, followed by the shorter contacts. The connector exhibits a lower peak insertion force because not all of the connectors mate in parallel (i.e. at the same time).

Connectors with differential height contacts, however, may not be preferred in high contact density miniaturized connectors. Producing differential height contacts are viewed as impractical due to the strict manufacturing tolerances required.

Consequently, a need exists for a connector that exhibits acceptable insertion force characteristics in a high density, miniaturized environment.

SUMMARY OF THE INVENTION

The shortcomings of the prior art are overcome in the present invention by a frame including a first component and a second component. The frame components substantially surround first and second connector halves, each half including an insulative housing and a plurality of contacts secured to the insulative housing. The frame components engage in order to progressively mate the contacts of the connector. Each frame is preferably stamped and formed from a sheet of suitable conductive material.

These and other objects of the present invention are achieved in another aspect of the present invention by a frame having a first component and a second component rotatably engageable along an axis of rotation. Each frame component substantially surrounds a connector half having an insulative housing and a plurality of contacts secured to the insulative housing. The contacts are arranged generally perpendicular to the axis of rotation.

These and other objects of the present invention are achieved in another aspect of the present invention by a method for mating a connector substantially surrounded by a connector frame, having a first component and a second component. The connector includes a first half and a second half, each including an insulative housing and a plurality of contacts secured to the housing. The method includes the steps of engaging the first and second components; and progressively connecting the contacts of the first and second connector halves.

These and other objects of the present invention are achieved in another aspect of the present invention by a board-to-board array conenctor which includes first and second halves, both attachable to respective substrates. The halves each include an insulative housing and a plurality of contacts secured to the housing and arranged in a series of columns. A board-to-board frame is also provided having first and second frame components, each substantially surrounding respective connector halves and secured to the surface of respective substrates. An end of the first frame component has a hinge assembly, for mating with a hinge mating portion of an end of the second frame component. The frame components are rotated to progressively mate columns of the connector halves in a direction away from the hinge assemblies.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

In general, the present invention is a board-to-board electrical connector frame that surrounds electrical connector plug and receptacle halves to be mated, yielding a high density, low peak insertion force connector. In accordance with the present invention, rather than mating the contacts of the connector halves in parallel (i.e. all of the contacts at the same time), the connector frame sequentially mates the contacts. Sequential mating of the contacts is achieved by preferably rotating a first connector frame component holding one connector half relative to a second connector frame component holding the other connector half. Hinge assemblies on the first and second connector frame components interface to allow rotation and alignment of the contacts of the respective connector halves precisely. The sequential mating of the connector contacts by the connector frame of the present invention causes the connector to exhibit a lower peak mating force when compared to electrical connectors that mate contacts in parallel.

Figure 1:
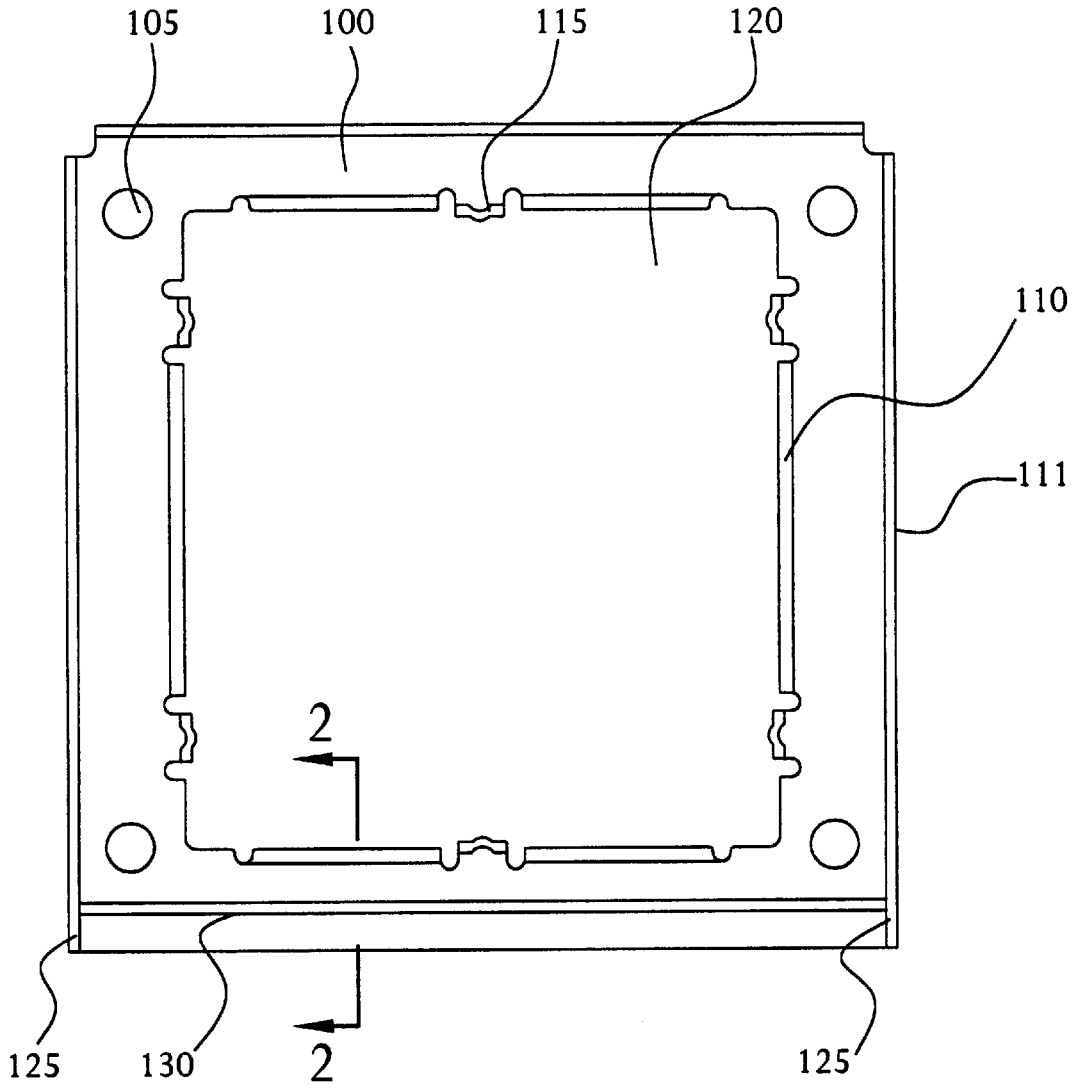
FIG. 1 is a plan view of a first connector frame component constructed in accordance with the present invention.
Figure 2:
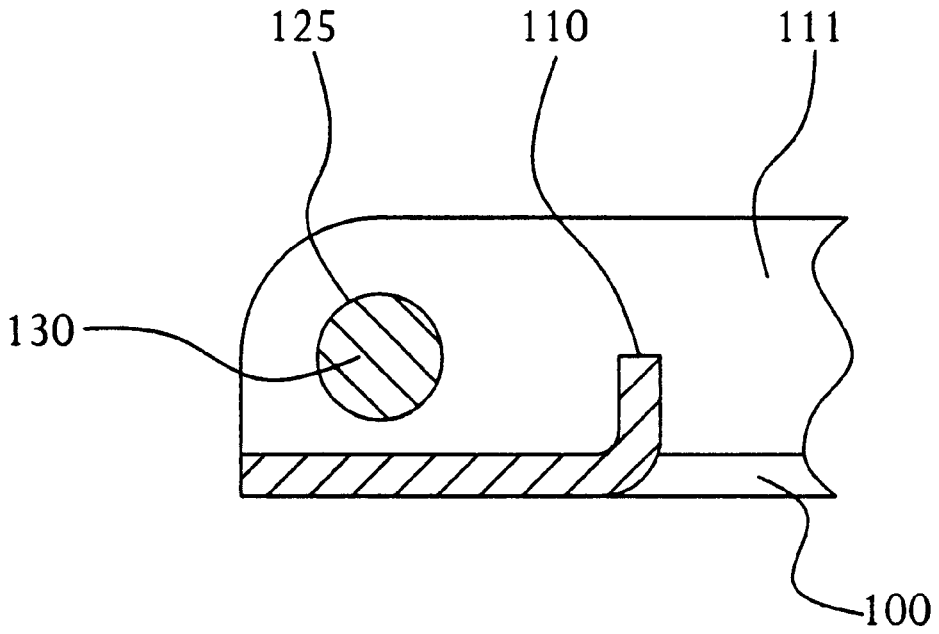
FIG. 2 is a side view of the portion of FIG. 1 denoted by 2—2.

FIGS. 1–6 display a first embodiment of the present invention. As shown by FIG. 1, a first connector frame component 100, for surrounding and holding one connector half, e.g., a receptacle half, to be positioned in rectangular region 120, may have throughholes 105 for securing the connector frame to a printed circuit board, substrate or the like with suitable fasteners (e.g., screws, bolts or rivets). Extended portions 115 interlock with corresponding depressed connector half housing portions (not shown FIGS. 11 and 12) for precise alignment. It is noted that any structure or technique for securely mounting the connector half to frame component 100 can be utilized without departure from the present invention. Connector frame walls 110 and 111 extend vertically out of the plane of FIG. 1 so as to define a substantially U or J-shaped cross section. Holes 125 are formed on opposing sides of the frame 100. Support rod 130, which is the basis for one half of a hinge assembly of the first embodiment, has its ends inserted into holes 125. In this embodiment, frame 100 is preferably stamped and formed from a suitable sheet of conductive material, such as stainless steel.

Rather than using holes 105 to mount frame 100 to PCB 50 with suitable fasteners, frame 100 could be mounted, for example, to pads (not shown) on PCB 50 with solder. As with holes 105, preferably the corners of frame 100 mount to PCB 50. In one embodiment, frame 100 could have bosses (not shown) stamped therein to extend below the remainder of frame 100. The bosses would rest on the pads of PCB 50, with the remainder of frame 100 preferably remaining spaced from PCB 50. Frame 100 can mount to PCB 50 before, simultaneous with, or subsequent to mounting of connector half 300 to PCB 50. To surface mount frame 100 to PCB 50, frame 100 is preferably made from a suitable material, such as phosphor bronze, or the material could have a suitable plating thereon.

Figure 3:
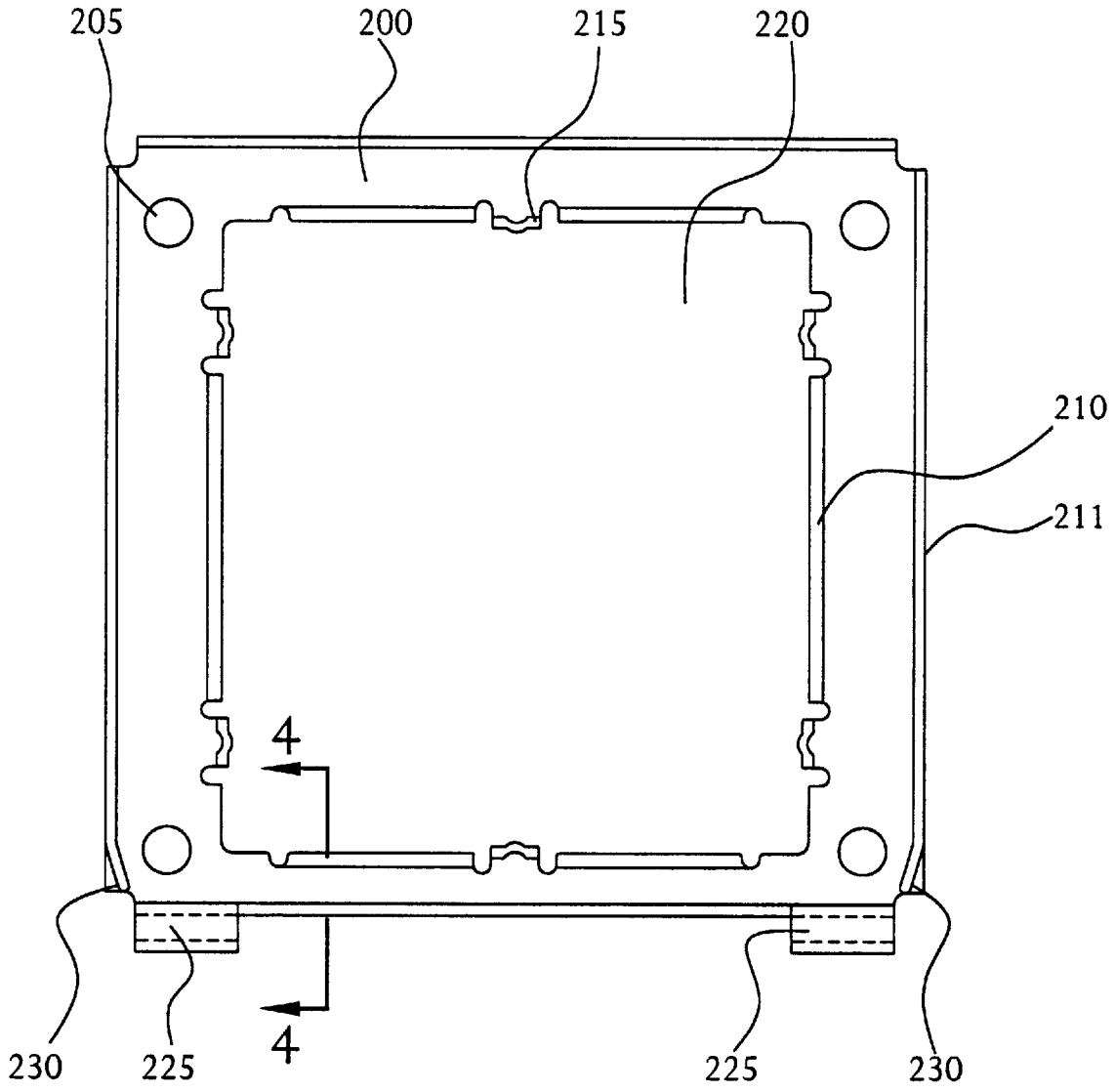
FIG. 3 is a plan view of a first embodiment of a second connector frame component in accordance with the present invention.
Figure 4:
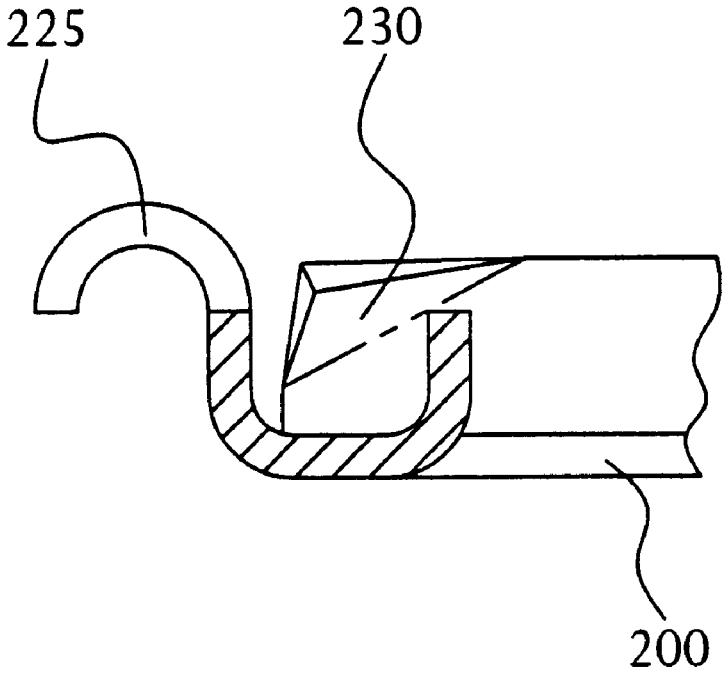
FIG. 4 is a side view of the portion of FIG. 3 denoted by 4—4.

As shown in FIG. 3, a second connector frame component 200, for surrounding and holding another connector half, e.g. a plug half, to be positioned in rectangular region 220 may have throughholes 205 for securing the connector frame to a printed circuit board, substrate or the like. Extended portions 215 interlock with corresponding depressed portions of the connector housing (not shown FIGS. 11 and 12?) for precise alignment. Again, it is noted that any structure or technique for securely mounting the connector half to frame component 100 can be utilized without departure from the present invention. Connector frame walls 210 and 211 extend vertically out of the plane of FIG. 3 so as to define a substantially U or J-shaped cross section.

When connector frame components 100 and 200 are mated, walls 110 and 210 preferably align in a generally co-planar manner. Whereas walls 211 are formed to align in a side by side manner with walls 111. This positioning is assisted by bent corner 230. In operation, as connector frame component 200 rotates towards connector frame component 100 any misalignment is corrected by the sliding action of wall 111 over bent corner 230. The bent corners 230 act as a lead-in surface which provides, initially, rough alignment between the frames 100, 200, then progressively finer alignment with further rotation of the frames 100, 200. As seen in FIG. 5B, the frames 100, 200 achieve sufficient alignment before any mating of contacts 300*a*, 400*a* occurs. If necessary, however, the contacts 300*a*, 400*a* can provide additional minor alignment to the connector during mating.

Figure 5A:
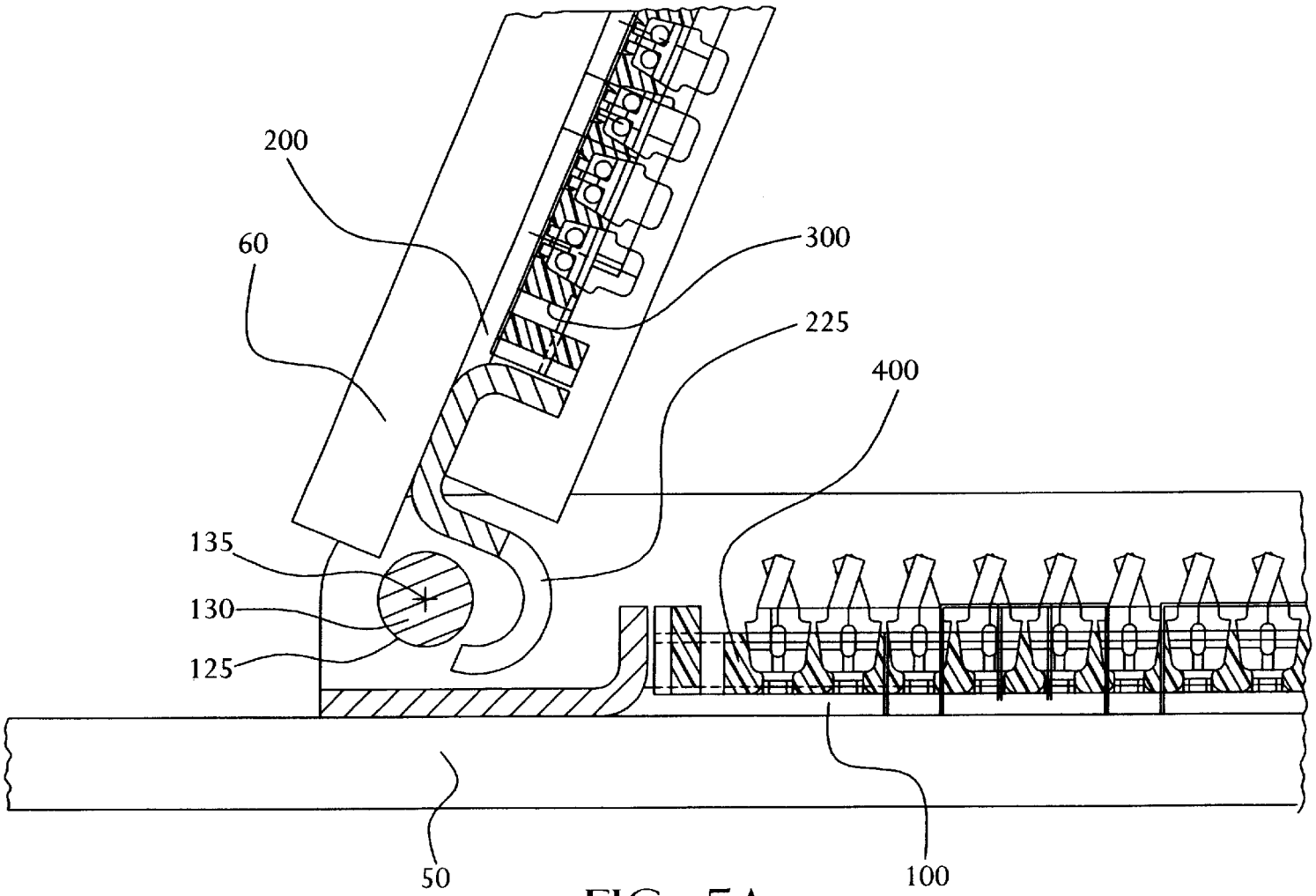
FIG. 5A is a side view of the first and second connector frame components of the first embodiment of the present invention before mating of a connector.
Figure 5B:
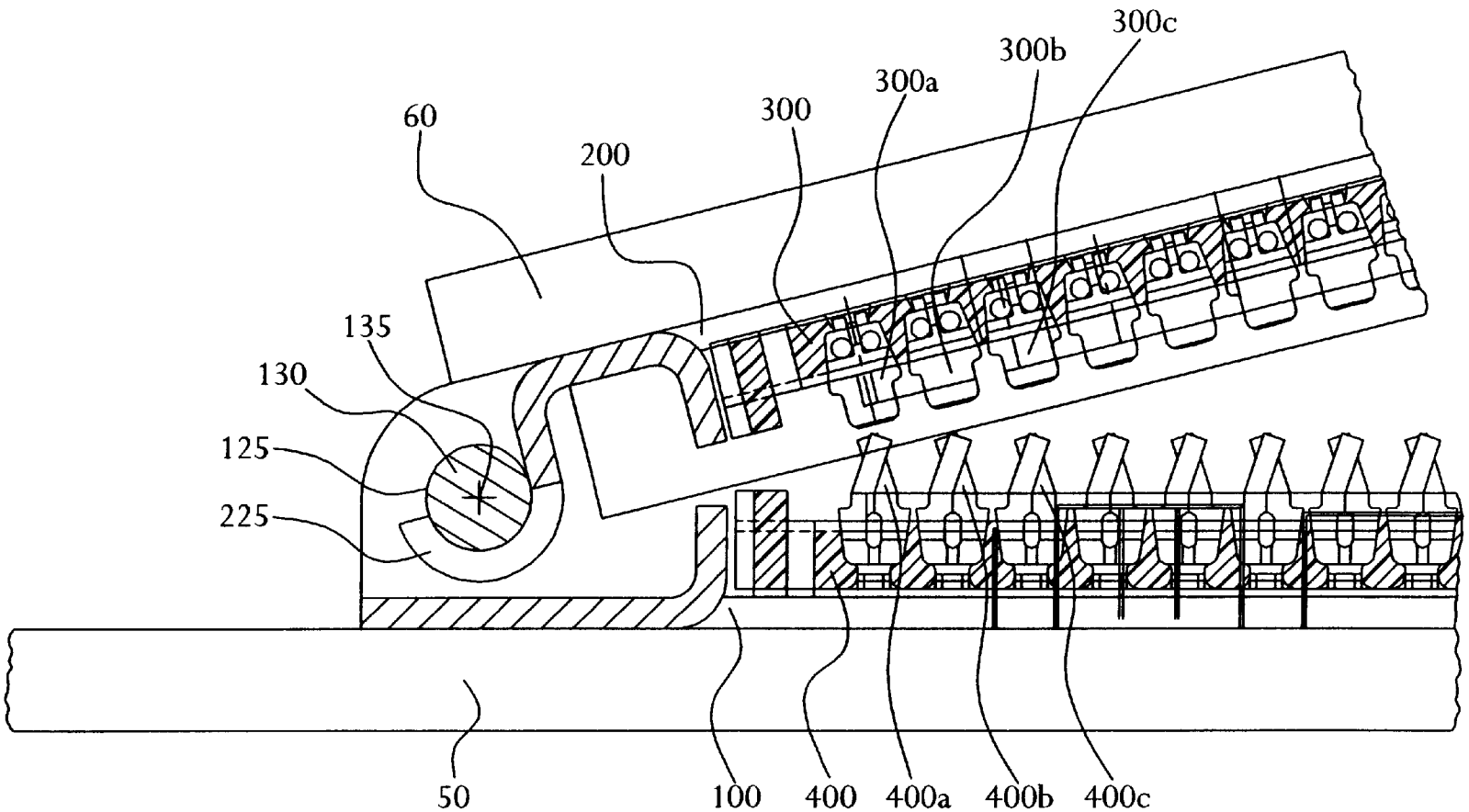
FIG. 5B is a side view of the first and second connector frame components of the first embodiment of the present invention during mating of a connector.

FIGS. 5 and 6 demonstrate workings of the hinge assembly and correspondingly, the mating action for plug and receptacle connector modules 300 and 400 positioned within and attached to frame components 100 and 200. Although shown as a single module, frames 100, 200 could accept a plurality of modules 300, 400. Each module 300, 400, preferably, would fit in a correspondingly sized opening 120, 220. Connector half 400 is surrounded by connector frame component 100, which in turn is secured to a substrate 50, such as a printed circuit board. Similarly, connector half 300 is positioned within and attached to frame component 200, which is secured to a substrate 60. Curved portions 225 are formed so as to hook between rod 130 and the bottom of frame 100. Rod 130 defines an axis 135 about which connector frame components 100 and 200 are rotatable with respect to each other. FIG. 5B shows the connector halves 300 and 400 in an unmated or open position. FIG. 5B shows the connector halves 300 and 400 in a near mated position i.e., at the point of rotation of connector frame components 100 and 200 right before the contacts of the connector halves touch. It will be appreciated from this view that subsequently, a sequential mating of contacts will occur.

First, row of contacts 300*a* will mate with row of contacts 400*a*, then row of contacts 300*b* will mate with row of contacts 400*b*, then row of contacts 300*c* will mate with row of contacts 400*c*, and so on. Due to the sequential mating of rows, the peak insertion force for the connector will be minimized since the insertion forces associated with the individual rows of contacts do not occur simultaneously.

Figure 6A:
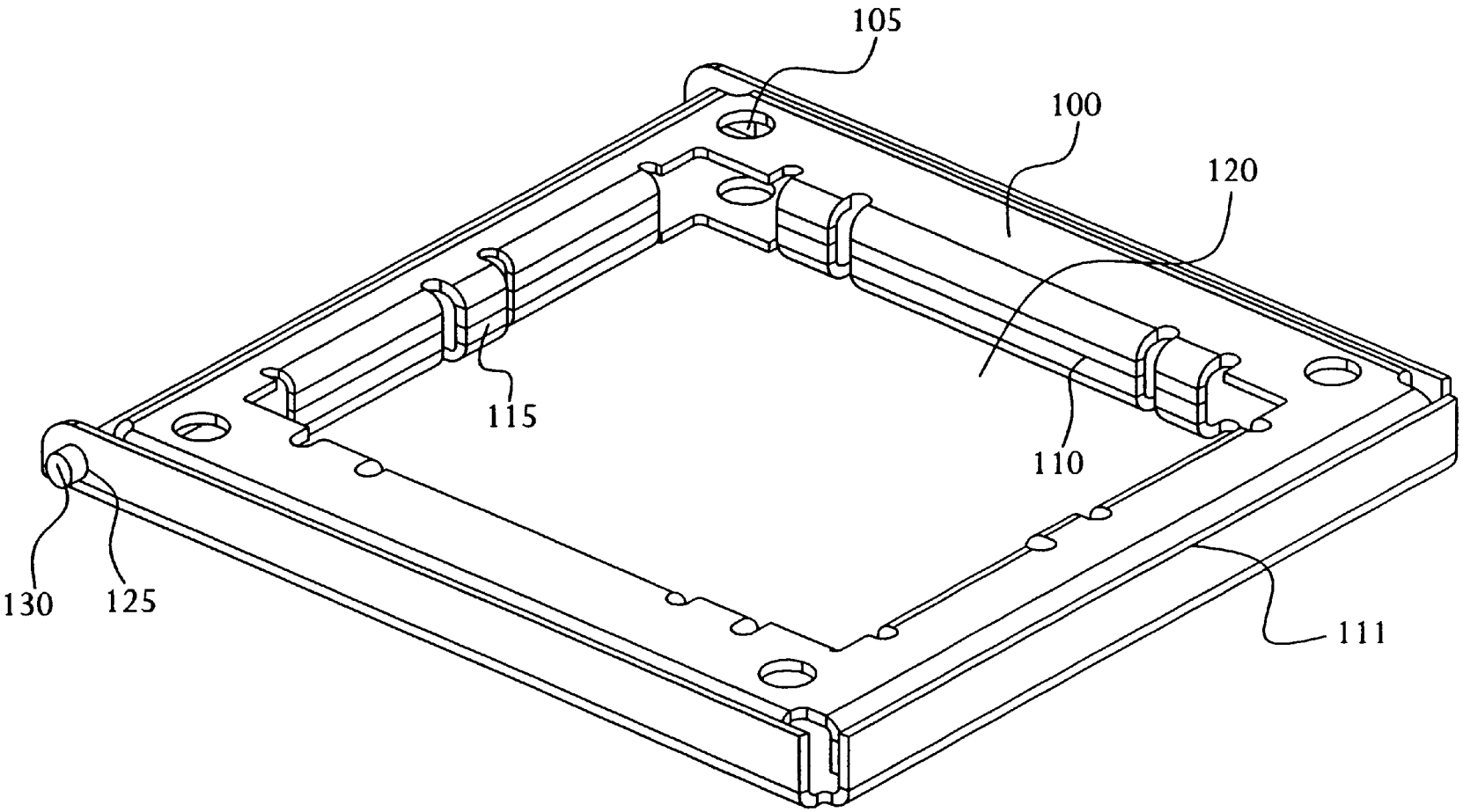
FIGS. 6A and 6B are illustrations of mated first and second connector frame components of the first embodiment of the present invention without modules surrounded thereby and/or attached thereto.
Figure 6B:
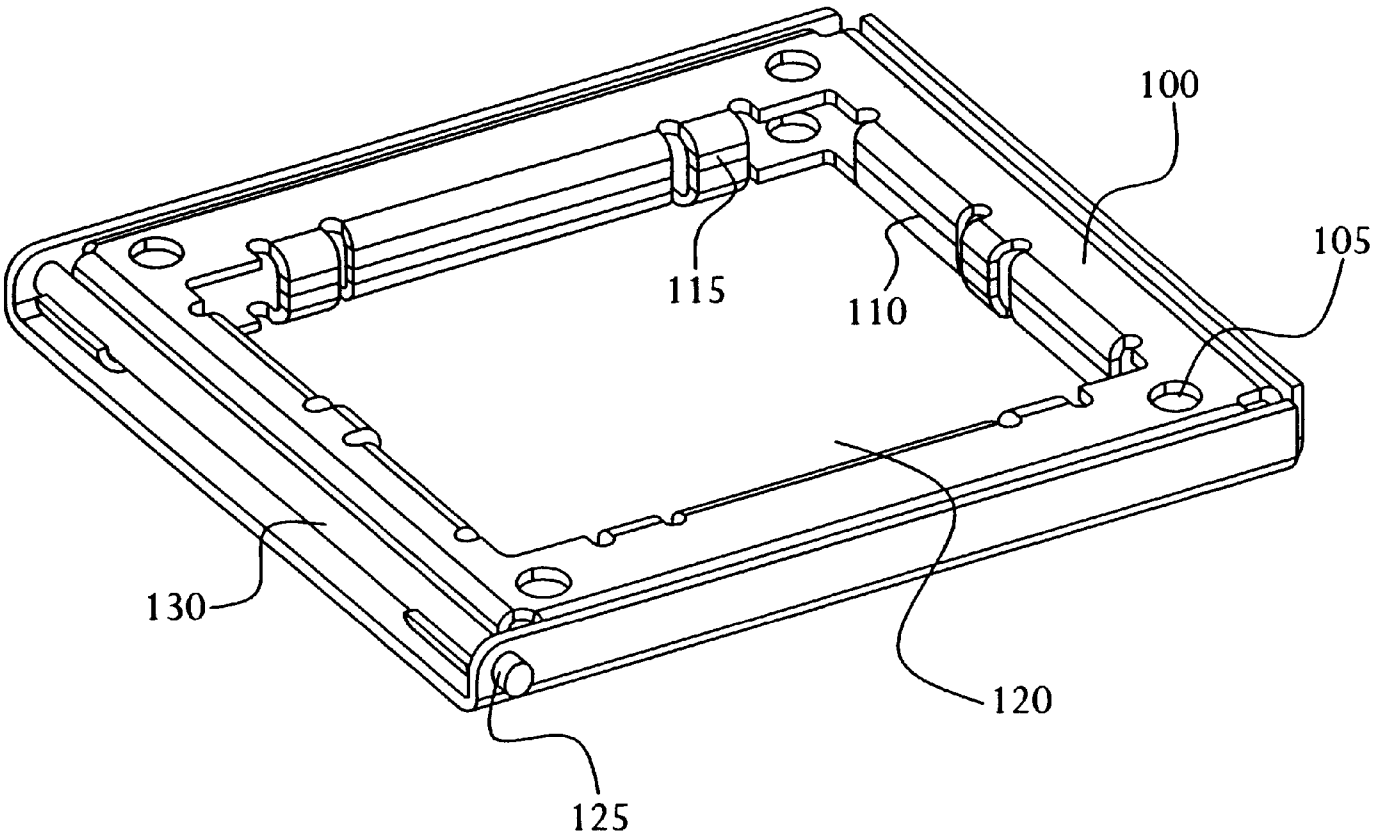

The difference in the coefficient of thermal expansion (CTE) of the substrates and the connector, and coplanarity of the connector frames are two important considerations with large scale array connectors. CTE differential can introduce stress into the solder joints that couple the connector and the substrate. Solder joint stress potentially reduces the thermal reliability of the connector. CTE differential can also warp the connector. Connector warp potentially misaligns the mating connectors, increasing the required peak insertion force. Connector warp may also affect the coplanarity of the fusible components that couple the connector to the substrate. It can thus be appreciated that the provision of separate components which make each connector frame allows for some small amount of movement between connectors, to reduce the effects of CTE mismatch, while still providing precise alignment of the connector halves. FIGS. 6A and 6B are illustrations of mated first and second connector frame components of the first embodiment of the present invention without modules 300, 400.

Figure 7A:
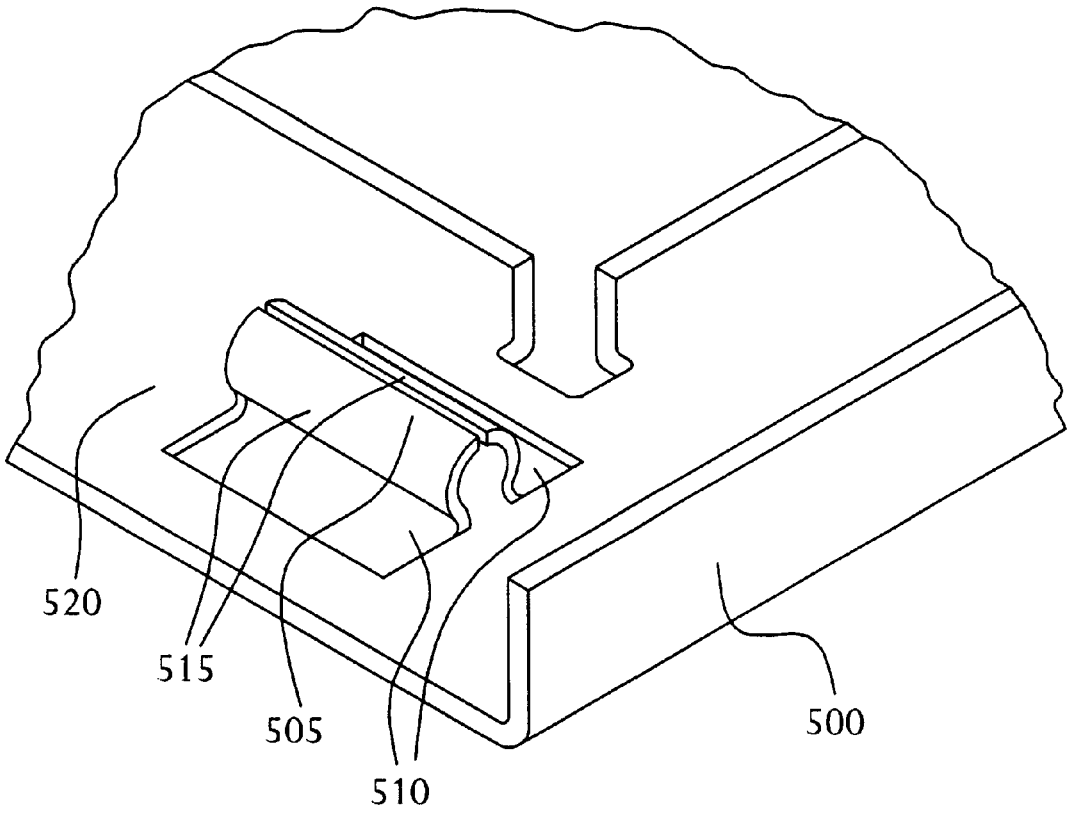
FIG. 7A is a perspective view of a second embodiment of a first connector frame component in accordance with the present invention.

FIG. 7A depicts an alternative embodiment of a connector frame construction in accordance with the present invention. A portion of a first connector frame half 500 having a part of a hinge assembly formed thereon is shown. Portions 515 of sheet metal base frame 520 have been scaled back and bent upwards to form a substantially circular arch 505 defining throughputs 510. Connector frame half 500, similar to connector frame 100, is designed to surround and attach to a connector half as with the first embodiment. Frame 500 is preferably soldered around arch 505 to prevent frame 500 from lifting off of a printed circuit board (PCB).

The structure of frame half 500 can be used with a connector frame component 200, as described with respect to the first embodiment. In such a combination, the rod 130 of the first embodiment is replaced by arch 505, throughputs 510 and the area underneath arch 505. With a corresponding arch portion 505 located on the other side of such a connector frame component 500, the mating action will be substantially the same as shown and described with respect to FIGS. 5 and 6. The arch portions 505, correspond to and cooperate with curved portions 225 of a connector frame component 200, providing an axis of rotation to achieve sequential contact mating of a connector.

Figure 7B:
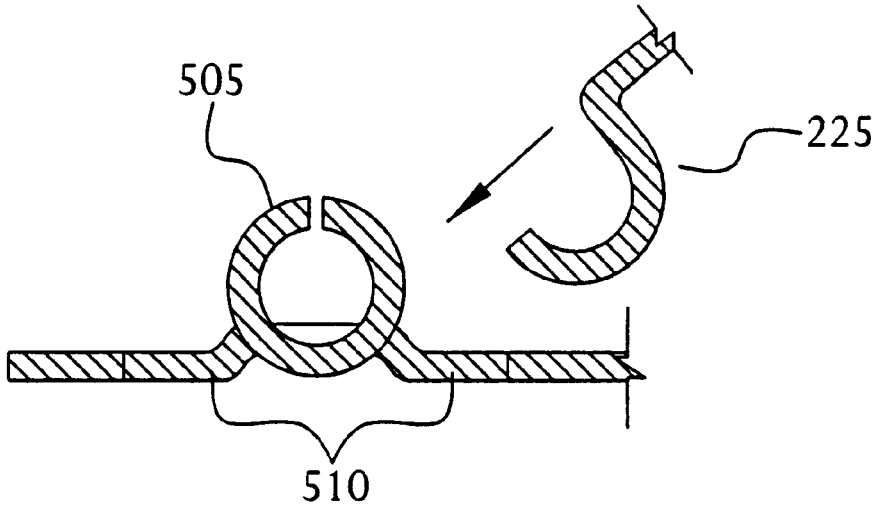
FIG. 7B illustrates the hinge assembly of a second embodiment in accordance with the present invention.

FIG. 7B illustrates the hinge assembly of FIG. 7A in more detail. A curved portion 225, when directed towards and underneath arch 505 via throughputs 510, forms the hinge assembly of the present embodiment. Arch 505 is elevated to allow curved portion/extension 225 to slide underneath more easily.

Figure 8:
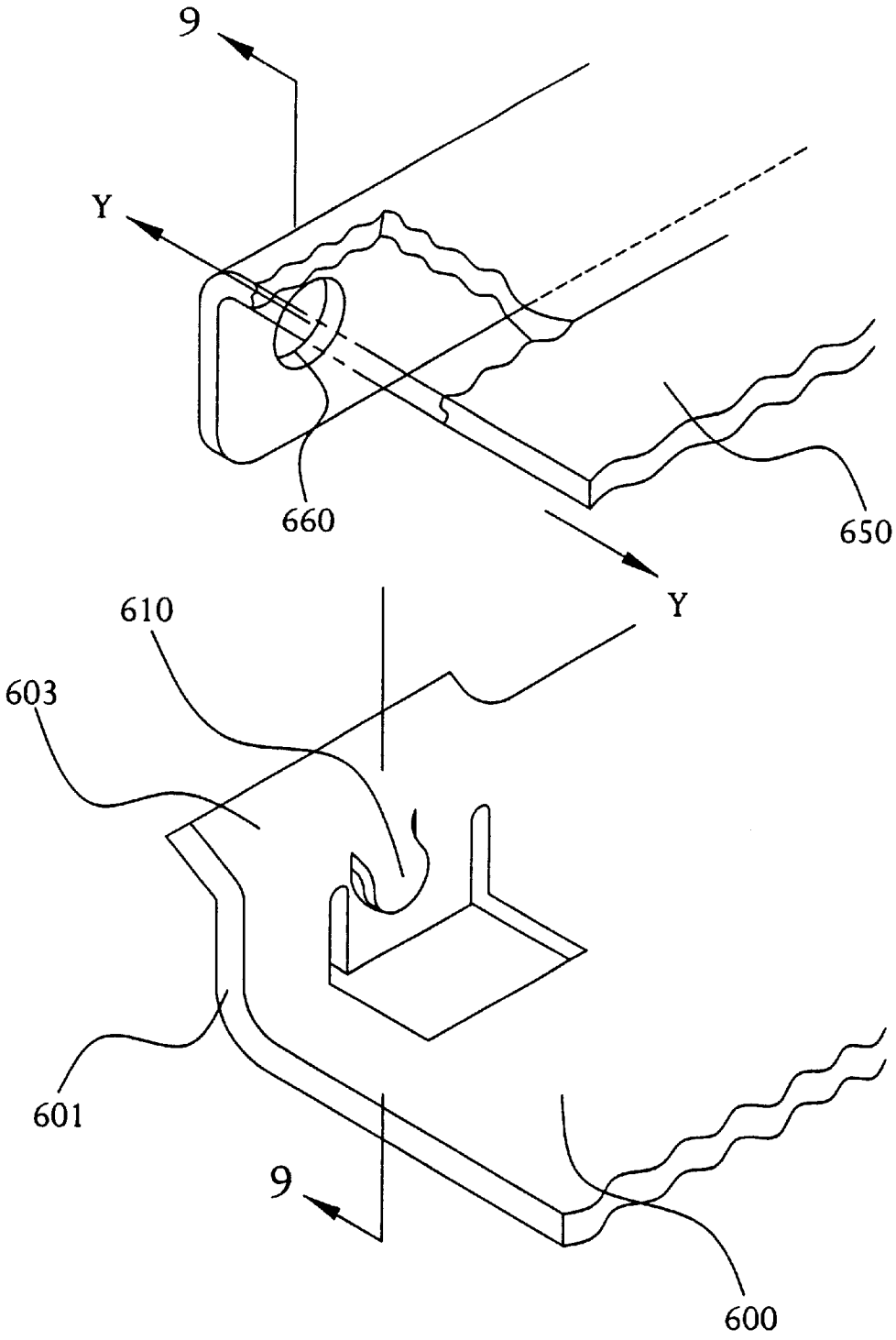
FIG. 8 is a perspective view of a third embodiment of first and second connector frame components in accordance with the present invention.
Figure 9:
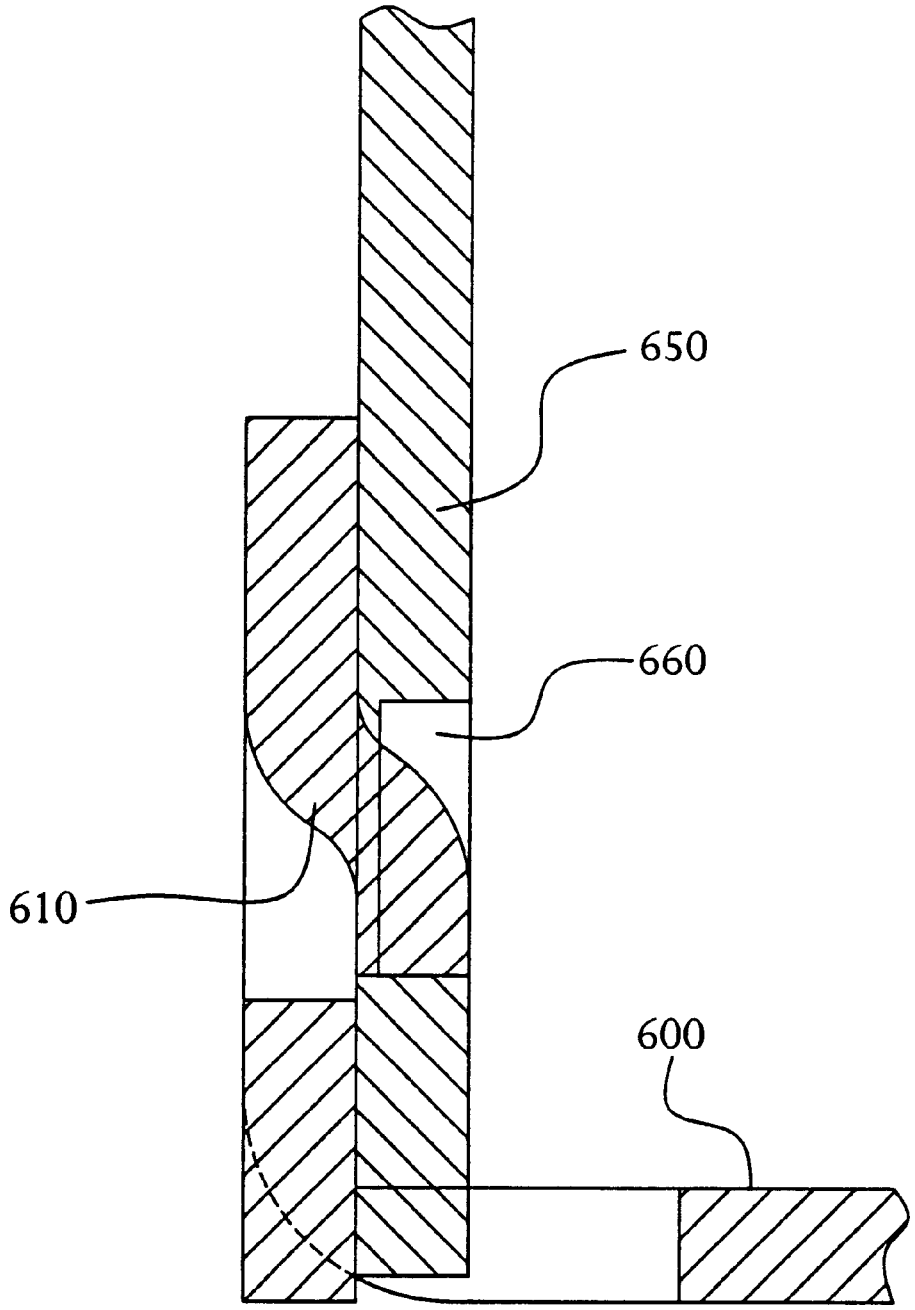
FIG. 9 is a cut-out side view of a mating portion of the third embodiment of first and second connector frame components in accordance with the present invention.

FIGS. 8–9 illustrate a third embodiment of a connector frame constructed in accordance with the present invention. A portion of a first connector frame component 600 and a portion of a second connector frame component 650 constitute a part of a hinge assembly. Frame component 600 has an extending tang 610 adapted to fit inside hinge hole 660 in frame component 650. Tang 610 preferably has a width less than the diameter of hinge hole 660 to allow rotation of the frames 100, 200 without interference. Connector frame components 600 and 650, similar to frame halves 100 and 200, are designed to surround and attach to connector halves as with the first and second embodiments. Consequently, when connector frame component 650 rotates about an axis y substantially defined by the center of hinge hole 660, sequential mating of the contacts of connector halves surrounded by the frame components is achieved. FIG. 9 is a section view of the tang 610/hole 660 hinge assembly when connector frame components 600 and 650 have positioned a connector in the un-mated condition.

In this embodiment, frame 650 deflects tab 610 during insertion into frame 600. Once hole 660 aligns with tab 610, tab 610 will resile to a position within hole 660. Other methods of securing frames 600, 650 are possible, however. For instance, tab 610 could be bent into hole 660 after frame 650 is aligned with frame 600. In addition, side wall 601 of frames 600 could have a dimple (not shown) rather than tab 610. Similar to the other embodiments, the dimple would reside within hole 660 of frame 650 to allow rotation of frames 600, 650.

As seen in FIG. 8, side walls 601 of frame 600 include outwardly flared sections 603. As with bent corners 230 of frame 200, outwardly flared sections 603 act as lead-in surfaces. Outwardly flared sections 603 provide, initially, rough alignment between frames 600, 650. The outwardly flared sections 603 then provide progressively finer alignment with further rotation of the frames 600, 650. The frames 600, 650 achieve sufficient alignment before any mating of contacts occurs. If necessary, however, the contacts can provide additional minor alignment to the connector during mating.

Figure 10:
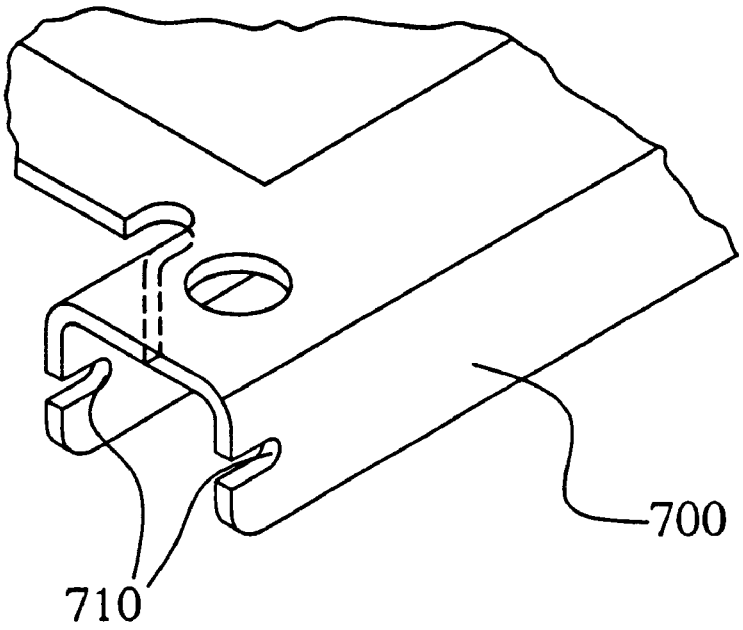
FIG. 10 is a perspective view of a connector frame component of a fourth embodiment of the present invention.

FIG. 10 is a perspective view of a further embodiment of a connector frame constructed in accordance with the present invention. Connector frame component 700 can be employed in conjunction with connector frame half 100 of the first embodiment, the connector frame component 500 of the second embodiment, and like embodiments. If used in conjunction with frame half 100, rectangular or U-shaped indentations 710 guide connector frame component 700 onto rod 130. Connector frame component 700 can then rotate about rod 130, to achieve the sequential mating as taught and described with respect to FIGS. 5 and 6.

Figure 11:
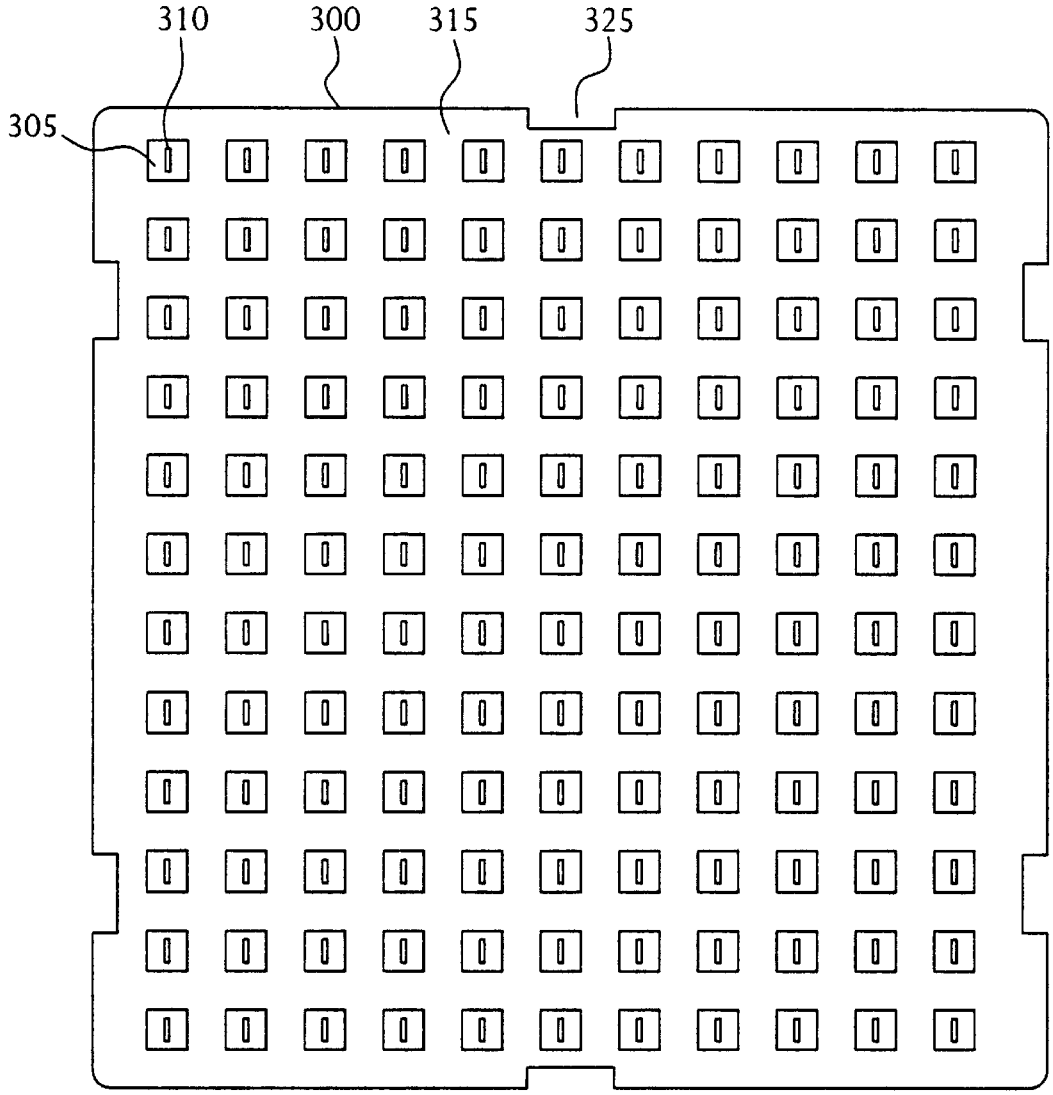
FIG. 11 is a plan view of a first half of an exemplary high density connector to be mated by the various frame connector embodiments of the present invention.
Figure 12:
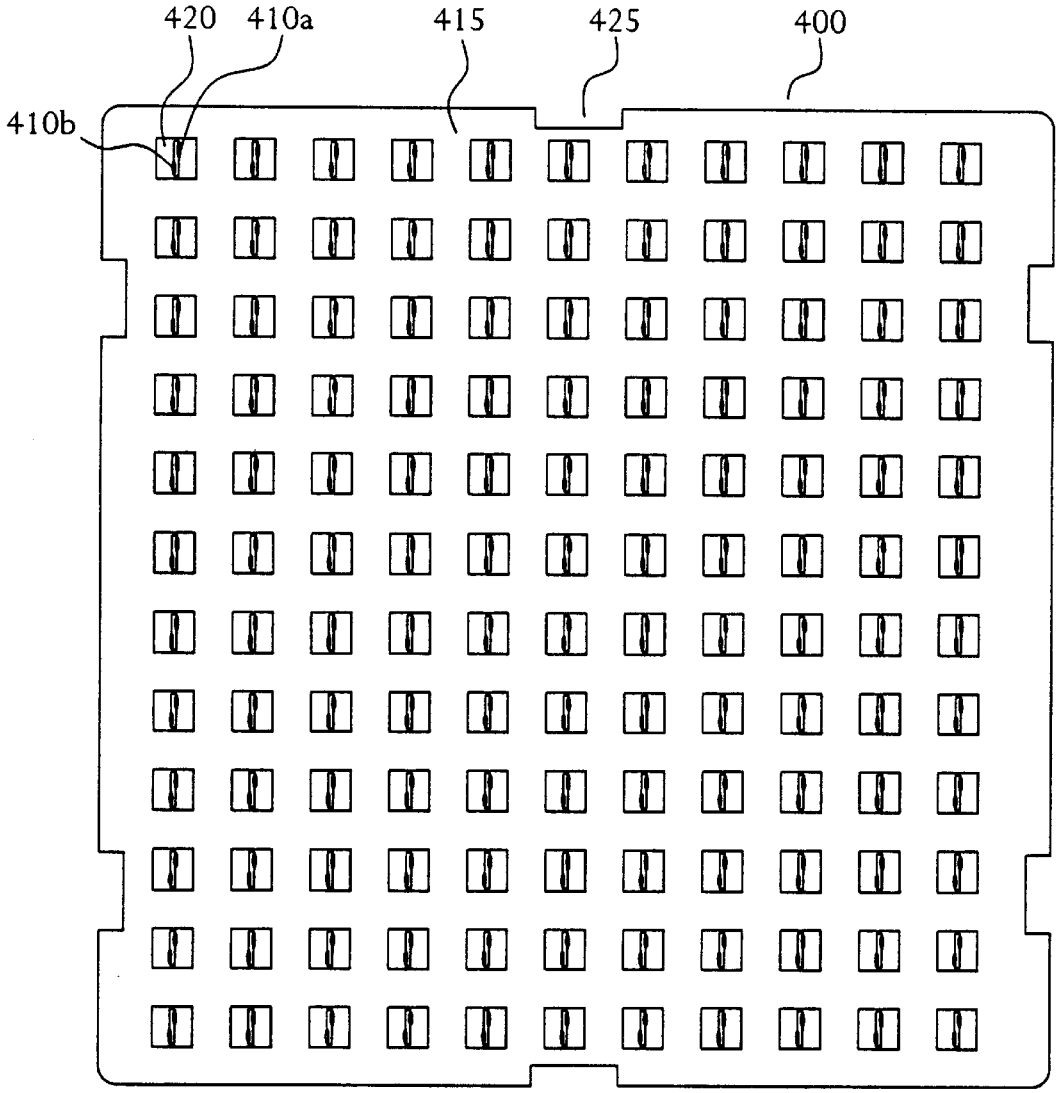
FIG. 12 is a plan view of a second half of an exemplary high density connector to be mated by the various frame connector embodiments of the present invention.

Each of the embodiments of a connector frame in accordance with the present invention are designed so that a connector frame component surrounds, positions, mounts to or holds a connector half stationary relative to the connector frame component. FIGS. 11 and 12 illustrate exemplary plug and receptacle connector modules. Connector halves 300 and 400 generally have a planar insulative housing 315 and 415, respectively, and are preferably manufactured from a plastic, such as liquid crystal polymer (LCP). Connector halves 300 and 400 have a mounting side (not shown) that faces a substrate, e.g., and is suitable for the arrangement and attachment of various types of high density grid array solder technology such as ball grid array, ceramic grid array, column grid array and the like, and as disclosed in International Publication number WO 98/15989 (hereby incorporated by reference).

Arrays of contacts 310 and 410*a*–*b* reside within arrays of apertures 305 and 420 in housings 315 and 415, respectively. Apertures 305 and 420 preferably retain contacts 310 and 410*a*–*b* within housings 315 and 415 using, for example, a projection extending into the apertures from a side wall. Contacts 315 and 415 remain within apertures 305 and 420, e.g., by an interference fit with the projection. Since connector half 300 generally mates with connector half 400 along an axis that is generally defined by the various hinge assemblies of connector frame embodiments of the present invention, contacts 310 and 410*a–b* are also generally perpendicular to the mating axis of connector halves 300 and 400. Housings 315 and 415 extend around the perimeter to protect contacts 310 and 410*a–b* from damage and act as a board stiffener. As seen in FIGS. 1 and 3, and as could be the case for any of the embodiments of the present invention, walls 110 and 210 can extend around the entire perimeter of housings 315 and 415, and portions 115, 215 frictionally retain modules 300, 400 by engaging depressed portions 325, 425. Other methods of retaining modules are possible. For instance, modules 300, 400 could have a stop (not shown) or latch structure (not shown) to retain the portions 115, 215 to modules 300, 400 in a more positive manner than a friction fit.

Although the figures display blade-type contacts on the plugs, other types of contacts, such as round pins, could be used with the present invention. In addition, the connector halves 300 and 400 could employ several different types of contacts at one time. Also, some contacts could carry a signal or ground, while others carry power. This, for example, allows the connectors of the present invention to be hot matable.

Figure 13:
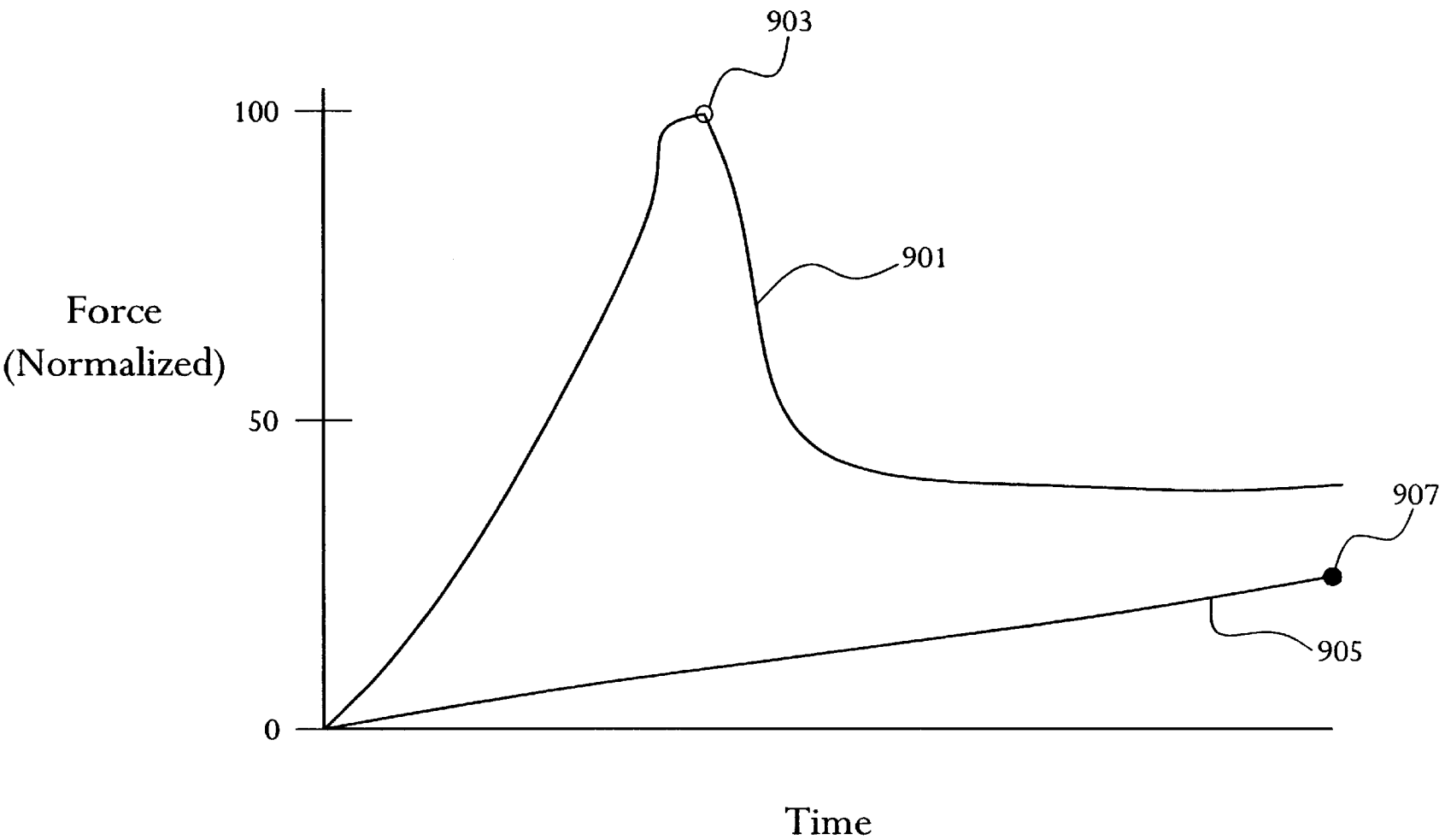
FIG. 13 is a graph comparing estimated insertion forces with and without the connector frame of the present invention.

FIG. 13 compares the estimated insertion forces for a typical connector and estimated insertion forces for a connector mated with a connector frame of the present invention. As used herein, a typical connector refers to a connector in which all of the contacts mate in parallel. In other words, a typical connection without a connector frame in accordance with the present invention mates all of the contacts at the same time. A typical connector produces the insertion force-versus-time path designated 901 in FIG. 13. A typical connector exhibits a peak at the point designated 903 along path 901. The peak is located approximately midstream along the time period.

A connector frame of the present invention mating a connector (using the same number of contacts, but sequentially mated) produces the insertion force-versus-time path designated 905 in FIG. 13. The connector frame technique of the present invention exhibits a peak at the point designated 907 along path 905. The peak is located approximately at the end of the time period. Hence, the peak insertion force 907 due to a connector frame of the present invention is well below the peak insertion force 903 of a parallel mating of a typical connector.

While the present invention has been described in connection with the preferred embodiments of the various figures, it is to be understood that other similar embodiments may be used or modification and additions may be made to the described embodiment for performing the same function of the present invention without deviating therefrom. For example, while an exemplary connector has been depicted in FIGS. 11 and 12, it can be appreciated by one of ordinary skill in the art of connector design, that numerous variations of high density connectors exist, and that it would be obvious to include variant connector designs with the rotatable mating as provided in the present invention. Furthermore, while a connector frame in accordance with the present invention is preferably made of sheet metal, for durability and low cost of manufacture, there are numerous materials, such as plastics, ceramics, and the like which would also provide low cost, high durability solutions. Therefore, the present invention should not be limited to any single embodiment, but rather construed in breadth and scope in accordance with the recitation of the appended claims.

What is claimed is:

1. A connector frame for use in joining first and second connector elements, said connector frame comprising:

a first frame portion adapted to attach to said first connector element, said first frame portion comprising a first structure for rotational attachment;

a second frame portion adapted to attach to said second connector element, said second frame portion comprising a second structure for rotational attachment, said first and second rotational structures cooperating to enable rotation of said second frame structure relative to said first frame structure, said first frame portion being stamped and formed from a conductive sheet material; and said second frame portion being stamped and formed from a conductive sheet material.

2. The connector frame as recited in claim 1, wherein said first connector element includes a first connector housing and contacts attached to said first connector housing and said second connector element includes a second connector housing and contacts attached to said second connector housing;

whereby the connector frame progressively mates said first and second connector element contacts.

3. The connector frame as recited in claim 2, wherein said first frame portion is releasably engageable to said first connector housing; and said second frame portion is releasably engageable to said second connector housing.

4. The connector frame as recited in claim 2, wherein said first and second rotational structures define a hinge assembly allowing rotation of said first frame portion relative to said second frame portion.

5. The connector frame as recited in claim 4, wherein the mating of said contacts attached to said first and second connector housings progresses in a direction away from said hinge assembly.

6. The connector frame as recited in claim 4, wherein the connector frame construction exhibits an insertion force for said first and second connector elements that generally increases as mating of said first and second connector element contacts progresses from a beginning to an end.

7. The connector frame as recited in claim 4, wherein said hinge assembly comprises:

a first hinge assembly on said first component, comprising:

a hinge pin;

a plurality of supports connected to said hinge pin; and a second hinge assembly on said second component, comprising:

a plurality of indentations, each for engaging said hinge pin.

8. The connector frame as recited in claim 4, wherein said hinge assembly comprises:

a first hinge assembly on said first component, comprising:

a hinge pin;

a plurality of supports connected to said hinge pin; and a second hinge assembly on said second component, comprising:

at least one extension, for engaging said hinge pin.

9. The connector frame as recited in claim 8, wherein each of said extensions is curved.

10. The connector frame as recited in claim 2, wherein said first connector element further comprises a plurality of fusible components, each connected to a respective one of said first connector element contacts; and said second connector element further comprises a plurality of fusible components, each connected to a respective one of said second connector element contacts.

11. The connector frame as recited in claim 10, wherein said fusible components comprise solder balls.

12. The connector frame as recited in claim 4, wherein said hinge assembly comprises:

a first hinge assembly on said first component, comprising:

a first plurality of arms extending from said first component, said arms defining an axis of rotation; and a second hinge assembly on said second component, including:

a second plurality of arms, for engaging said first plurality of arms, whereby said second frame component is capable of rotating relative to said first frame component.

13. The connector frame as recited in claim 12, wherein said plurality of arms have a substantially arch-shaped profile, and said second plurality of arms move about said first plurality of arms via a plurality of holes.

14. The connector frame as recited in claim 4, wherein said hinge assembly comprises:

a first hinge assembly on said first component, comprising:

a plurality of projections extending from said first component; and a second hinge assembly on said second component, comprising:

a plurality of holes for receiving said projections therein.

15. The connector frame as recited in claim 14, wherein said plurality of projections are tangs so as to approximate a ball in socket type hinge assembly for rotating said first connector element relative to said second connector element.

16. The connector frame of claim 1 wherein the first frame portion includes inner and outer sidewalls.

17. The connector frame of claim 16 wherein the first frame forms least one of a U-shaped and a J-shaped cross section.

18. The connector frame of claim 16 wherein the inner sidewalls define a space therebetween for receiving the first connector half.

19. The connector frame of claim 16 wherein the inner walls include extending portions protruding inwardly therefrom for mounting with a portion of the first connector element.

20. The connector frame of claim 16 further comprising a means for roughly aligning said first frame portion and said second frame portion upon relative rotation therebetween.

21. The connector frame of claim 16 wherein said second frame portion includes a bent wall portion, whereby the bent wall portion urges against a portion of said first frame portion for roughly aligning said first frame portion and said second frame portion upon relative rotation therebetween.

22. The board to board connector frame of claim 16 further comprising a means for roughly aligning said first component and said second component upon relative rotation therebetween.

23. The board to board connector frame of claim 16 wherein said second component includes a bent wall portion, whereby the bent wall portion urges against a portion of said first component for roughly aligning said first component and said second component upon relative rotation therebetween.

24. A board-to-board connector frame, comprising:

a first component that secures a first connector element, said first component including:

a first hinge assembly at one end, said first connector element having:

a first connector housing; and contacts attached to said first connector housing; and a second component that secures a second connector element and engageable with said first component, said second component including:

a second hinge assembly at an end engageable with said first hinge assembly, said second connector element having:

a second connector housing; and contacts attached to said second connector housing matable with said first connector element contacts, whereby the connector frame progressively mates said first and second connector element contacts.

25. A board to board connector frame as recited in claim 24, wherein said first component is rotatable relative to said second component to progressively mate rows of said first and second connector element contacts in a direction away from said hinge assemblies.

26. The board to board connector frame as recited in claim 24, wherein said first hinge assembly comprises:

a hinge pin;

a plurality of supports connected to said hinge pin; and said second hinge assembly comprises:

a plurality of indentations, each for engaging said hinge pin.

27. The board-to-board connector frame of claim 24 wherein said contacts attached to said first connector housing and said contacts attached to said second connector housing are arranged in a series of rows parallel to said first hinge assembly.

28. A board to board connector frame as recited in claim 24, wherein said first hinge assembly comprises:

a hinge pin;

a plurality of supports bracing said hinge pin; and said second hinge assembly comprises:

a plurality of extensions, each for engaging said hinge pin.

29. The board to board connector frame as recited in claim 28, wherein each of said extensions is curved.

30. The board-to-board connector frame as recited in claim 24, wherein said first hinge assembly comprises:

a first plurality of extensions extending from said first component;

a plurality of throughputs positioned adjacent to said first plurality of extensions; and said second hinge assembly comprises:

a second plurality of extensions, each for engaging said first plurality of extensions, respectively.

31. The board to board connector frame as recited in claim 30, wherein said plurality of extensions have a substantially arch-shaped profile, and said second plurality of extensions move about said first plurality of extensions via said plurality of throughputs.

32. The board to board connector frame as recited in claim 24, wherein said first hinge assembly comprises:

a plurality of projections extending from said first component; and said second hinge assembly comprises:

a plurality of holes for receiving said projections therein.

33. The board to board connector frame as recited in claim 32, wherein said plurality of projections are tangs so as to approximate a ball in socket type hinge assembly for rotating said first connector element relative to said second connector element.

34. A connector frame for use in joining first and second connector elements, said connector frame comprising:

a first frame portion adapted to attach to the first connector element, said first frame portion comprising an opening therein for receiving the first connector element, a support rod, and a pair of opposing sidewalls, opposing ends of the support rod being supported by the sidewalls and extending therethrough; and a second frame portion adapted to attach to the second connector element, said second frame portion comprising a hook extending outwardly from a remainder of the second frame portion and including an end disposed opposite the remainder of the second frame portion, said hook engaging said support rod to define a hinge assembly enabling rotation of said first frame portion relative to said second frame portion.

35. A connector frame for use in joining first and second connector elements, said connector frame comprising:

a first frame portion adapted to attach to the first connector element, said first frame portion being stamped and formed from a sheet of conductive material;

an arch formed in a portion of the first frame portion and an aperture formed in the sheet proximate the arch, whereby a portion of the sheet is deformed to form the arch and aperture;

a second frame portion adapted to attach to the second connector element, said second frame portion comprising a hook extending outwardly from a remainder of the second frame portion and including an end disposed opposite the remainder of the second frame portion, said hook disposed through said aperture to engage said arch thereby defining a hinge assembly enabling rotation of said first frame portion relative to said second frame portion.

36. A connector frame for use in joining first and second connector elements, said connector frame comprising:

a first frame portion adapted to attach to the first connector element, said first frame portion being stamped and formed from a sheet of conductive material; said first frame portion including opposing first frame sidewalls;

a pair of opposing tangs formed in the first frame sidewalls and protruding therefrom;

a second frame portion adapted to attach to the second connector element, said second frame portion comprising opposing second frame sidewalls, and a pair of opposing apertures formed in the second frame sidewalls said tangs resiliently engaging said apertures upon assembly of said first frame portion and said second frame portion to define a hinge assembly enabling rotation of said first frame portion relative to said second frame portion.

37. A connector frame for use in joining first and second connector elements, said connector frame comprising:

a first frame portion adapted to attach to the first connector element, said first frame portion comprising an opening therein for receiving the first connector element, a support rod, and a pair of opposing sidewalls, opposing ends of the support rod being supported by the sidewalls and extending therethrough; and a second frame portion adapted to attach to the second connector element, said second frame portion comprising a pair of opposing members defining a plane that is substantially perpendicular to a longitudinal axis of the support rod, each one of said members including an indentation notched therein for receiving the support rod therein, thereby defining a hinge assembly enabling rotation of said first frame portion relative to said second frame portion.

* * * * *